US006322380B1

(12) United States Patent
Conroy

(10) Patent No.: US 6,322,380 B1
(45) Date of Patent: Nov. 27, 2001

(54) SAFETY LIGHT SOCKET

(76) Inventor: Martin E. Conroy, 17 Hillcrest Ave., San Anselmo, CA (US) 94960

( * ) Notice: Subject to any disclaimer, the term of this patent is extended or adjusted under 35 U.S.C. 154(b) by 0 days.

(21) Appl. No.: 09/637,675

(22) Filed: Aug. 14, 2000

(51) Int. Cl.[7] ..... H01R 29/68
(52) U.S. Cl. ..... 439/188; 439/667
(58) Field of Search ..... 439/188, 911, 439/419, 667, 666, 339

(56) References Cited

U.S. PATENT DOCUMENTS 4,949,229 * 8/1990 Bassi ..... 362/92
5,069,632 * 12/1991 Avitan ..... 439/188
5,595,493 * 1/1997 Chen ..... 439/188
5,643,006 * 7/1997 Wang et al. ..... 439/419
5,685,761 * 11/1997 Schepens ..... 445/63
5,743,758 * 4/1998 Cheng et al. ..... 439/188
5,980,304 * 11/1999 Lin ..... 439/188
6,068,499 * 5/2000 Kuriyama et al. ..... 439/188

* cited by examiner

*Primary Examiner*—Gary Paumen
(74) *Attorney, Agent, or Firm*—Goldstein Law Offices, P.C.

(57) ABSTRACT

A safety light socket including a cylindrical socket defined by an upper end, a lower end, and a cylindrical side wall therebetween. The cylindrical socket includes a cylindrical recess extending downwardly of the upper end thereof. The cylindrical recess includes an open upper end, a closed lower end, and an interior cylindrical wall therebetween. The interior cylindrical wall is threaded for receiving a light bulb. The closed lower end of the cylindrical recess has a spring extending upwardly therefrom. A primary contact is secured to the spring of the cylindrical recess of the cylindrical socket. A secondary contact is secured to the closed lower end of the cylindrical recess of the cylindrical socket.

3 Claims, 2 Drawing Sheets

SAFETY LIGHT SOCKET

BACKGROUND OF THE INVENTION

The present invention relates to a safety light socket and more particularly pertains to preventing electrical shock.

The use of light receptacle devices are known in the prior art. More specifically, light receptacle devices heretofore devised and utilized for the purpose of safely operating light bulbs are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,643,006 to Wang discloses a construction for a safe light bulb socket, having a waterproof assembly for exterior use. U.S. Pat. No. 5,685,761 to Schepens discloses a tool for safely testing and repairing screw-bulb sockets. U.S. Pat. No. 4,949,229 to Bassi discloses a light bulb holding device.

While these devices fulfill their respective, particular objective and requirements, the aforementioned patents do not describe a safety light socket for preventing electrical shock.

In this respect, the safety light socket according to the present invention substantially departs from the conventional concepts and designs of the prior art, and in doing so provides an apparatus primarily developed for the purpose of preventing electrical shock.

Therefore, it can be appreciated that there exists a continuing need for a new and improved safety light socket which can be used for preventing electrical shock. In this regard, the present invention substantially fulfills this need.

SUMMARY OF THE INVENTION

In the view of the foregoing disadvantages inherent in the known types of light receptacle devices now present in the prior art, the present invention provides an improved safety light socket. As such, the general purpose of the present invention, which will be described subsequently in greater detail, is to provide a new and improved safety light socket which has all the advantages of the prior art and none of the disadvantages.

To attain this, the present invention essentially comprises a cylindrical socket defined by an upper end, a lower end, and a cylindrical side wall therebetween. The cylindrical socket includes a cylindrical recess extending downwardly of the upper end thereof. The cylindrical recess includes an open upper end, a closed lower end, and an interior cylindrical wall therebetween. The interior cylindrical wall is threaded for receiving a light bulb. The closed lower end has a cylindrical collar extending upwardly therefrom. The cylindrical collar has a spring disposed therein. The spring has an upper end and a lower end. The lower end of the spring is secured to the closed lower end of the cylindrical recess. A primary contact is secured to the upper end of the spring of the cylindrical collar of the cylindrical socket. A secondary contact is secured to the closed lower end of the cylindrical recess of the cylindrical socket. The primary contact and the secondary contact form an operative circuit when touching that will close once a light bulb is positioned completely within the cylindrical recess of the cylindrical socket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved safety light socket which has all the advantages of the prior art light receptacle devices and none of the disadvantages.

It is another object of the present invention to provide a new and improved safety light socket which may be easily and efficiently manufactured and marketed.

It is a further object of the present invention to provide a new and improved safety light socket which is of durable and reliable construction.

An even further object of the present invention is to provide a new and improved safety light socket which is susceptible of a low cost of manufacture with regard to both materials and labor, and which accordingly is then susceptible of low prices of sale to the consuming public, thereby making such a safety light socket economically available to the buying public.

Even still another object of the present invention is to provide a new and improved safety light socket for preventing electrical shock.

Lastly, it is an object of the present invention to provide a new and improved safety light socket including a cylindrical socket defined by an upper end, a lower end, and a cylindrical side wall therebetween. The cylindrical socket includes a cylindrical recess extending downwardly of the upper end thereof. The cylindrical recess includes an open upper end, a closed lower end, and an interior cylindrical wall therebetween. The interior cylindrical wall is threaded for receiving a light bulb. The closed lower end of the cylindrical recess has a spring extending upwardly therefrom. A primary contact is secured to the spring of the cylindrical recess of the cylindrical socket. A secondary contact is secured to the closed lower end of the cylindrical recess of the cylindrical socket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
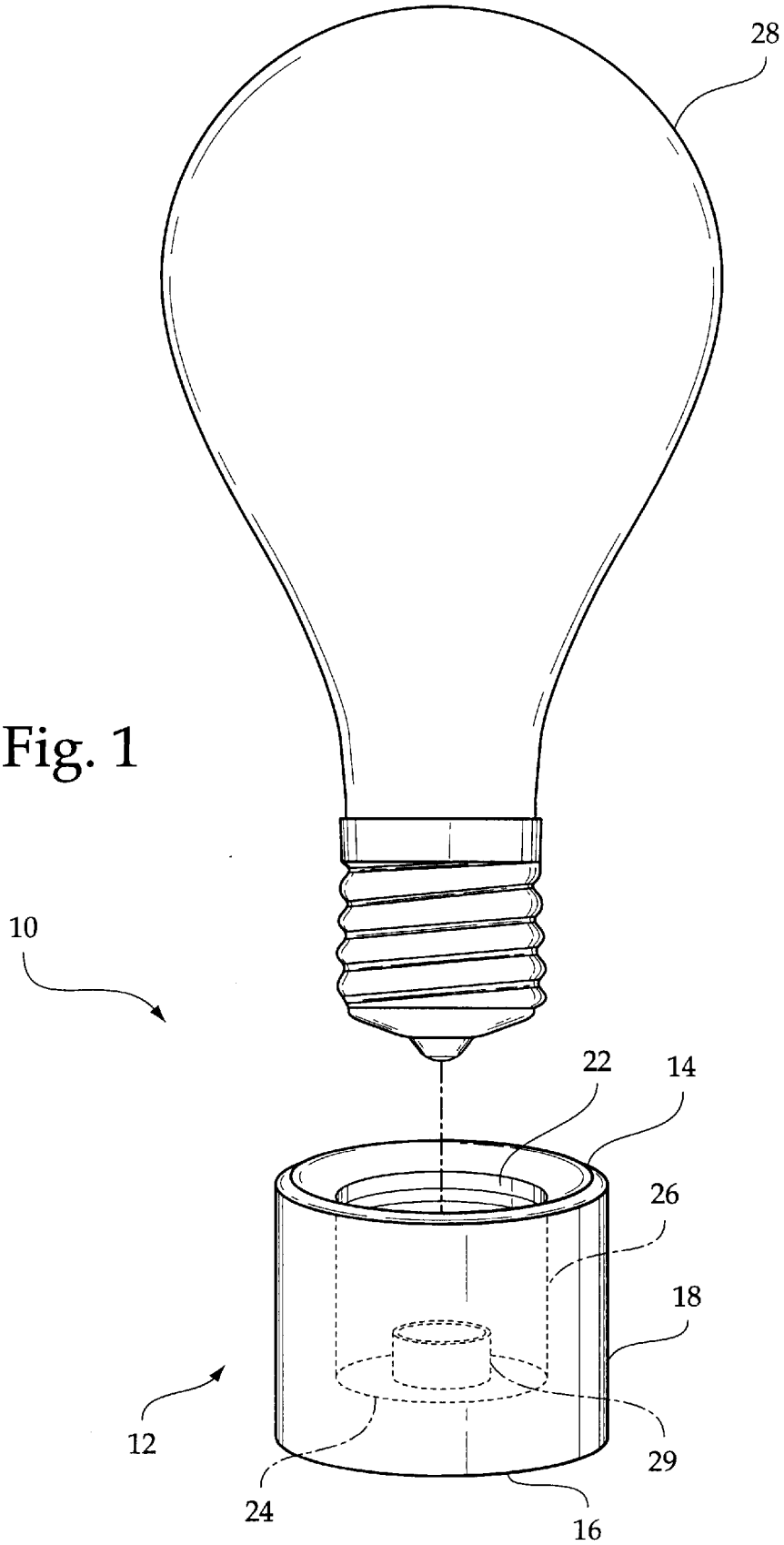
FIG. 1 is a perspective view of the preferred embodiment of the safety light socket constructed in accordance with the principles of the present invention.
Figure 3:
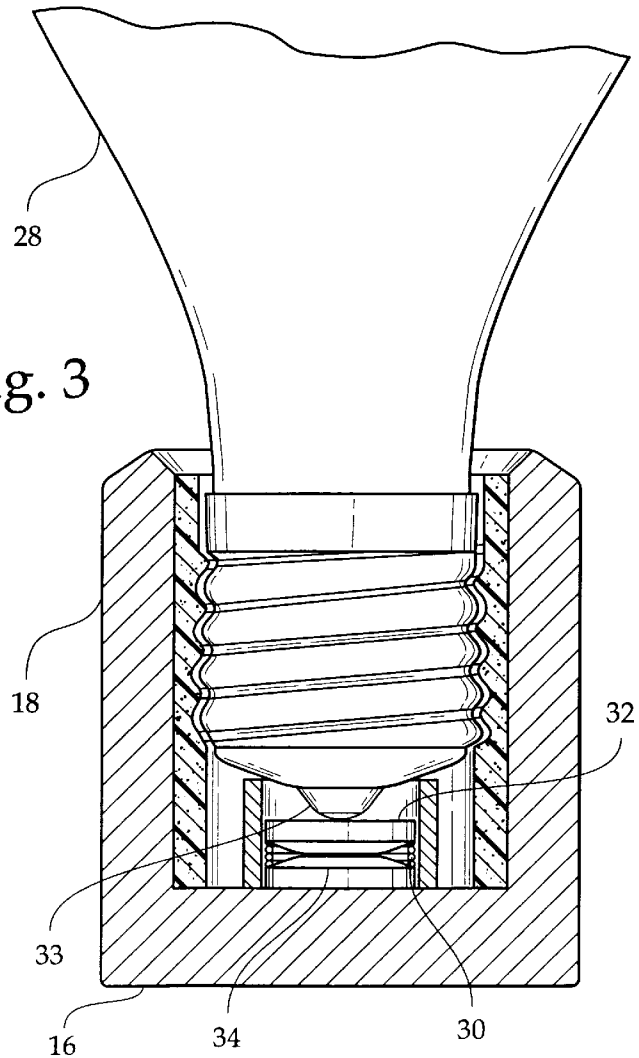
FIG. 3 is a cross-sectional side view of the present invention.
Figure 2:
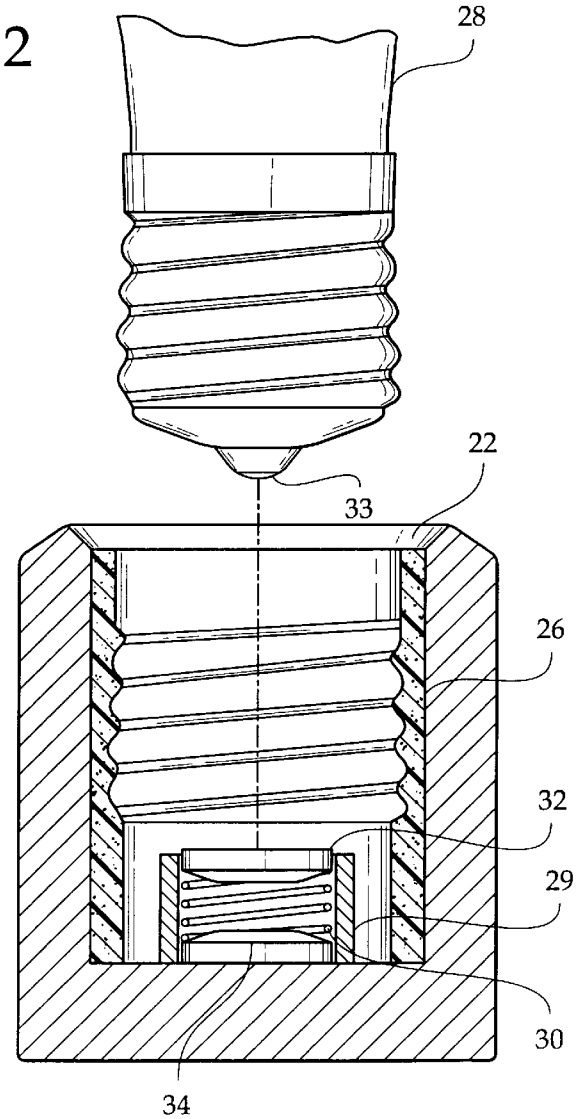
FIG. 2 is a side view of the present invention with a cut-away illustrating the secondary contact thereof.

With reference now to the drawings, and in particular, to FIGS. 1 through 3 thereof, the preferred embodiment of the new and improved safety light socket embodying the principles and concepts of the present invention and generally designated by the reference number 10 will be described.

Specifically, it will be noted in the various Figures that the device relates to a safety light socket for preventing electrical shock. In its broadest context, the device consists of a cylindrical socket, a primary contact, and a secondary contact. Such components are individually configured and correlated with respect to each other so as to attain the desired objective.

The cylindrical socket 12 is defined by an upper end 14, a lower end 16, and a cylindrical side wall 18 therebetween. The cylindrical socket 12 includes a cylindrical recess 20 extending downwardly of the upper end 14 thereof. The cylindrical recess 20 includes an open upper end 22, a closed lower end 24, and an interior cylindrical wall 26 therebetween. The interior cylindrical wall 26 is threaded for receiving a light bulb 28. The closed lower end 24 of the cylindrical recess 20 has a cylindrical collar 29 extending upwardly therefrom. The cylindrical collar 29 has a spring 30 disposed therein. The spring 30 has an upper end and a lower end. The spring will compress when the light bulb 28 is screwed into the cylindrical recess 20.

The primary contact 32 is secured to the upper end of the spring 30 of the cylindrical recess 20 of the cylindrical socket 12. Once the light bulb 28 is screwed into the cylindrical recess 20, a contact 33 of the light bulb 28 will abut the primary contact 32.

The secondary contact 34 is secured to the closed lower end 24 of the cylindrical recess 20 of the cylindrical socket 12. Once the light bulb 28 is screwed into the cylindrical recess 20, the primary contact 32 will be forced downwardly against the urging of the spring 30 to abut the secondary contact 24 to form an operative circuit that will only close once the light bulb 28 is positioned completely within the cylindrical recess 20 of the cylindrical socket 12. Thus, if the light bulb 28 is removed, a person cannot be shocked upon touching of the primary contact 32 or the secondary contact 34 even if the electricity has not been turned off.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A safety light socket for preventing electrical shock comprising, in combination:

a cylindrical socket defined by an upper end, a lower end, and a cylindrical side wall therebetween, the cylindrical socket including a cylindrical recess extending downwardly from the upper end thereof, the cylindrical recess including an open upper end, a closed lower end, and a discrete interior cylindrical wall therebetween, the interior cylindrical wall being threaded for receiving a light bulb, the closed lower end having a cylindrical collar extending upwardly therefrom, the cylindrical collar having a spring disposed therein, the spring having an upper end and a lower end, the lower end of the spring being secured to the closed lower end of the cylindrical recess;

a primary contact secured to the upper end of the spring of the cylindrical collar of the cylindrical socket;

a secondary contact secured to the closed lower end of the cylindrical recess of the cylindrical socket; and wherein the primary contact and the secondary contact forming an operative circuit when touching that will close once a light bulb is positioned completely within the cylindrical recess of the cylindrical socket.

2. A safety light socket for preventing electrical shock comprising, in combination:

a cylindrical socket defined by an upper end, a lower end, and a cylindrical side wall therebetween, the cylindrical socket including a cylindrical recess extending downwardly of the upper end thereof, the cylindrical recess including an open upper end, a closed lower end, and a discrete interior cylindrical wall therebetween, the interior cylindrical wall being threaded for receiving a light bulb, the closed lower end of the cylindrical recess having a spring extending upwardly therefrom;

a primary contact secured to the spring of the cylindrical recess of the cylindrical socket;

a secondary contact secured to the closed lower end of the cylindrical recess of the cylindrical socket and to the spring,;

wherein the primary contact and the secondary contact form an operative circuit that will only close once a light bulb is completely positioned within the cylindrical socket.

3. The safety light socket as set forth in claim 2, wherein the closed lower end of the cylindrical recess has a cylindrical collar extending upwardly therefrom, the cylindrical collar has the spring disposed therein.

* * * * *